US006866143B2

(12) United States Patent
Ovadia

(10) Patent No.: US 6,866,143 B2
(45) Date of Patent: Mar. 15, 2005

(54) UNITARILY MOLDED DISPLAY TRAY AND CLIPS

(76) Inventor: Joseph Ovadia, 109 Longhill Rd., Little Falls, NJ (US) 07424

( * ) Notice: Subject to any disclaimer, the term of this patent is extended or adjusted under 35 U.S.C. 154(b) by 130 days.

(21) Appl. No.: 10/268,625

(22) Filed: Oct. 10, 2002

(65) Prior Publication Data

US 2004/0069676 A1 Apr. 15, 2004

(51) Int. Cl.[7] ..... B65D 85/02
(52) U.S. Cl. ..... 206/6.1; 206/566
(58) Field of Search ..... 206/6.1, 560, 562, 206/565, 566, 493, 348; 211/85.2

(56) References Cited

U.S. PATENT DOCUMENTS 5,547,072 A * 8/1996 Kaiser ..... 206/765
5,649,625 A * 7/1997 Ovadia ..... 206/566
6,012,571 A * 1/2000 LaPierre ..... 206/6.1
6,029,829 A * 2/2000 Ovadia ..... 211/85.2

* cited by examiner

*Primary Examiner*—Jacob K. Ackun, Jr.
(74) *Attorney, Agent, or Firm*—Richard M. Goldberg

(57) ABSTRACT

A unitarily molded display tray for displaying articles of jewelry having indicia tags is provided. The display tray included a plurality of recesses dispersed upon a single-plane unitary surface. Each recess has a corresponding clip which extends from one edge of the recess above the unitary surface to form a gap between the clip and the unitary surface. The clip is resiliently attached to the edge of the recesses such that an article of jewelry, such as a ring, may be inserted into the gap. After placement into the gap, the upper portion of the ring rests on the clip while the lower portion of the ring extends partially into the recess on the unitary surface. Since the lower portion of the ring is hidden from view below the unitary surface, indicia tags attached to the ring may be attached to the portion of the ring which extends through the recess, thereby keeping the indicia tag out of sight of consumers viewing the rings in the display tray.

9 Claims, 8 Drawing Sheets

UNITARILY MOLDED DISPLAY TRAY AND CLIPS

FIELD OF THE INVENTION

This invention relates generally to devices for storing and displaying articles of jewelry, and more particularly, to a unitarily molded display tray having a plurality of clips for retaining articles of jewelry.

BACKGROUND OF THE INVENTION

Jewelry articles, particularly rings, can be stored and displayed in a variety of trays, holders or racks. The most common type of jewelry display for rings, described generally in U.S. Pat. No. 4,282,975, comprises a pad, generally of a plush felt or velvet material, which is placed in a tray, preferably of square or rectangular shape. The felt pad which rests within the tray is provided with a plurality of downwardly extending recesses into which a ring is inserted and which are generally configured such that the circular shank or lower portion of a ring is retained in the felt. The tray portion of this type of display is often configured to permit a plurality of trays to be nested upon each in stacked fashion.

However, rings and other articles of jewelry are often provided with indicia labels or tags that contain important information such as composition, i.e. gold, silver, platinum, etc., weight, price and/or bar codes. Since indicia labels often detract from the beauty of the jewelry being displayed, some jewelers in the trade neglect to attach indicia tags to the jewelry, resorting instead to looking up price, composition and weight information, etc., in an index or price book. This, however, takes time and customers may become impatient while waiting to receive all the information. Jewelers, thus prefer to attach indicia tags directly to the jewelry so as to have immediate access to all information pertaining to that article. It is, however, preferred by those in the jewelry trade to keep such indicia labels out of sight of potential customers since it is hoped that a customer will first be impressed by the ring which they may see in a store window or display case and then be enticed to enter the store to inquire further before seeing the price of the ring.

Prior art display trays, however, do not permit the rings to be stored and displayed while keeping the indicia tag out of sight. The upper surface of the prior art display tray are often provided with outwardly extending tabs permit only a limited portion of the indicia tag to be inserted underneath the tab. As such, the indicia tab is often left to hang free on the felt.

The prior art display trays have also been found to inadequately secure and retain the jewelry items within the display case, particularly when the trays are moved or transported. Often times since the rings are constantly removed and reinserted from the tabs in the felt upper surface, the salesperson neglects to fully insert the ring into the tab, thus leaving the ring in a virtually unsecured condition.

Accordingly, there is a need for a jewelry display tray employed to display and store articles of jewelry therein, and which avoids the disadvantages discussed above.

OBJECTS AND SUMMARY OF THE INVENTION

It is accordingly a principal object of the present invention to provide a jewelry display apparatus in the form of a tray which can be used both for display purposes as well as storage purposes.

A more specific object of the present invention is to provide a jewelry display tray unitarily molded from a lightweight plastic material and which has a unitary surface provided with a plurality of clips molded with the unitary surface and extending from a plurality of recesses dispersed about the surface of the tray for displaying and retaining jewelry items such as rings thereon.

It is another object of the present invention to provide a jewelry display tray which permits storage and display of rings arranged thereon in a fashion in which indicia tags attached to the rings are hidden from sight while viewing the rings thereon and which facilitates presentation of the rings arranged thereon in a pleasing arrangement.

It is a further object of the present invention to provide a jewelry display tray in which the rings arranged on the display tray are securely retained in place by the clips which are resiliently molded to the single-plane unitary surface.

Another object of the present invention is to provide a jewelry display tray in which the indicia tags are hidden from sight while viewing the rings thereon and may be viewed without having to remove the article of jewelry from the display tray by inverting the jewelry display tray.

In accordance with one aspect of the present invention, a unitarily molded display tray for displaying articles of jewelry is provided having a unitary surface comprised of an upper face and a lower face. Dispersed upon the upper face of the unitary surface is a plurality of recesses, each recess having two sets of first and second opposite sides. These recesses are arranged in rows, columns or staggered fashion. Each recess is provided with a corresponding clip arranged upon the upper face of the unitary surface. Each clip is molded from the unitary surface and resiliently extends across to one of the first set of opposite sides. The clips extend from the first side of the first set of opposite sides of the recess and are raised above the upper face of the unitary surface to define a gap between the clip and the upper face of the unitary surface. The remaining side of the first set of opposite sides along with the second set of opposite sides define the boundaries of the recess which preferably has an area larger than the area of the clip for providing an adequate space into which the shank portion of a ring extends when the ring is attached to a clip on the unitary surface of the display tray. Since the shank portion of the ring rests in the recess when the ring is arranged on the display tray, this arrangement permits the indicia tag that is attached to the ring to be inserted through or pulled through the gap and thus kept hidden from the sight of a consumer viewing the display tray.

Utilizing this arrangement, when the jewelry salesperson needs to examine the information on the indicia tag, he or she may then remove the ring from the display tray or may simply raise and invert the display tray and view the indicia tag from the underside of the display tray. This construction may also be provided with sidewalls substantially perpendicular to the unitary surface to facilitate placement on certain surfaces and for permitting stacking of numerous display trays.

The above description sets forth rather broadly the more important features of the present invention in order that the detailed description thereof that follows may be understood, and in order that the present contributions to the art may be better appreciated.

Other objects and features of the present invention will become apparent from the following detailed description considered in conjunction with the accompanying drawings. It is to be understood, however, that the drawings are designed solely for the purposes of illustration and not as a definition of the limits of the invention, for which reference should be made to the appended claims.

DETAILED DESCRIPTION OF THE DRAWINGS

In the drawings in which like reference characters denote similar elements throughout the several views.

DETAILED DESCRIPTION OF THE PRESENTLY PREFERRED EMBODIMENT

Figure 1:
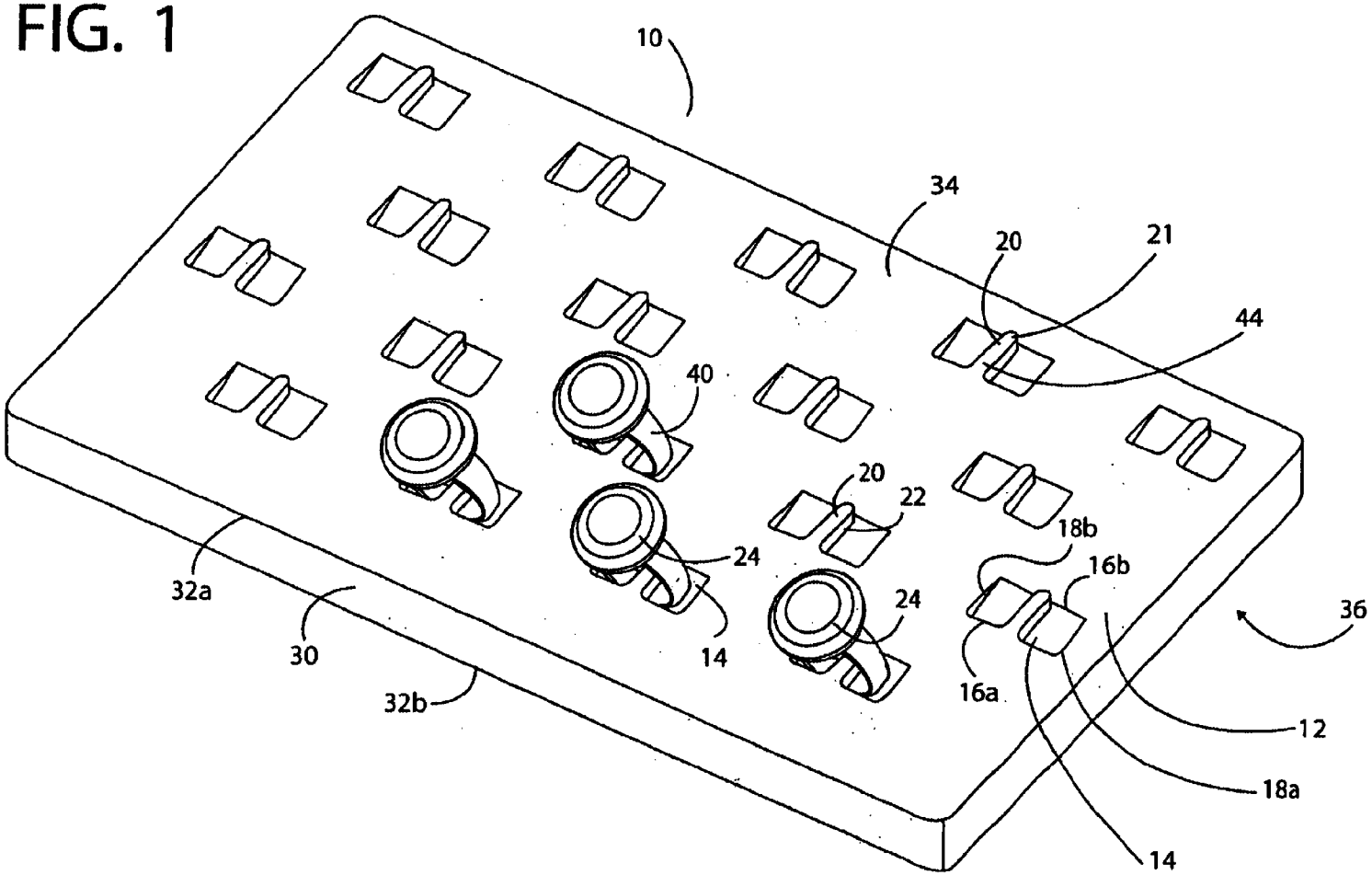
FIG. 1 illustrates a perspective view of the unitarily molded display tray of the present invention, illustrating the jewelry display tray designed to accommodate a plurality of rings for retention, in accordance with one embodiment of the present invention.
Figure 2:
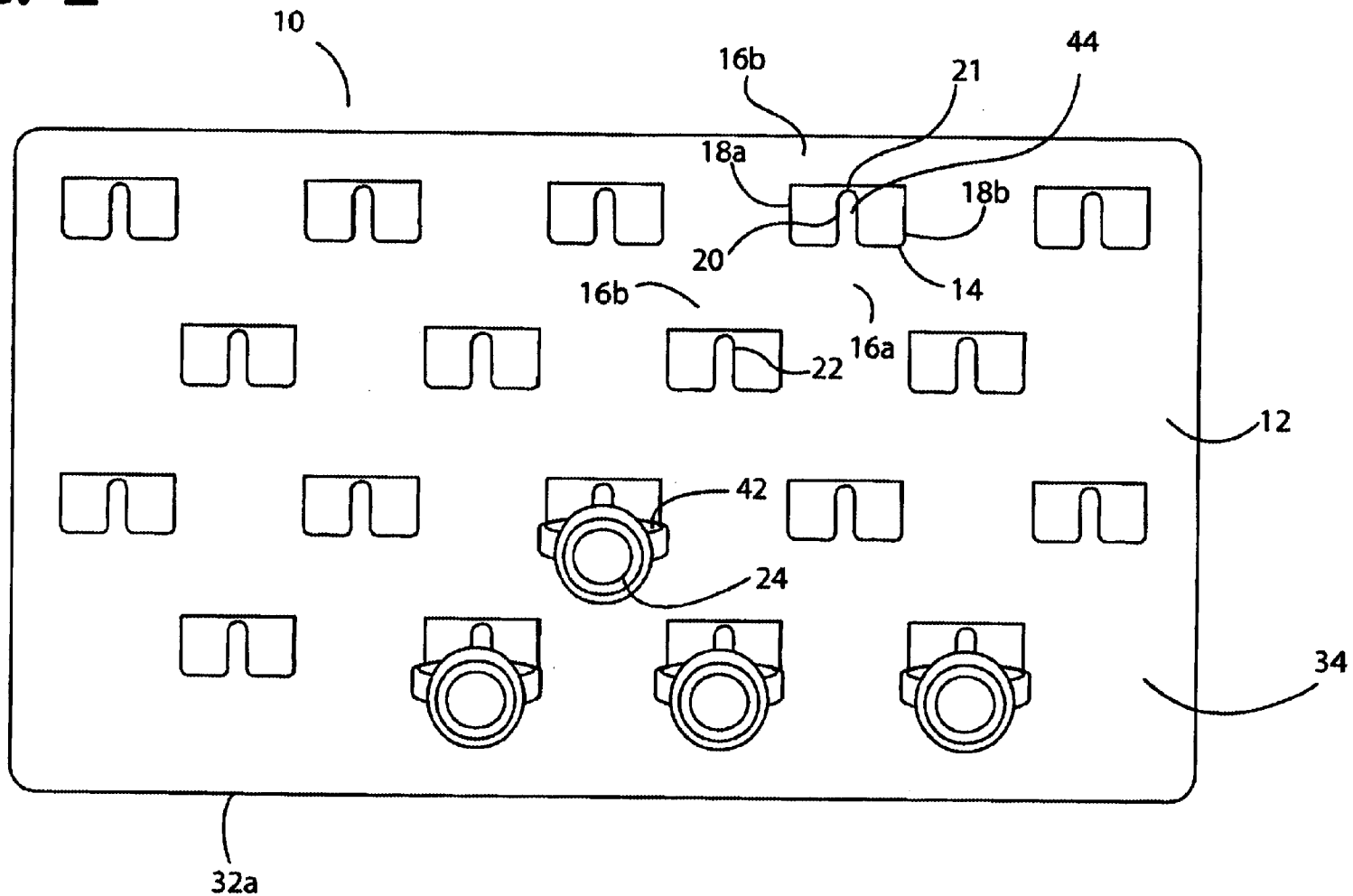
FIG. 2 illustrates a top plan view of the unitarily molded display tray of FIG. 1, in accordance with one embodiment of the present invention.

With initial reference to FIG. 1, the unitarily molded display tray 10 of the present invention is shown in its preferred embodiment. As illustrated, the display tray 10 is preferably comprised of a single-plane unitary surface 12, that is preferably flat, and which has an upper face 34 and a lower face 36, although the invention is not limited in scope in this respect. For example, surface 12 may comprise a multi-level surface depending on the user's requirements.

Display tray 10 may be configured for placement within a receptacle tray (not shown) configured to receive display tray 10. Unitary surface 12 is provided with a plurality of recesses 14 dispersed about unitary surface 12. Each recess 14 is further provided with a corresponding clip 20 unitarily molded with the single plane unitary surface 12 for retaining articles of jewelry within recesses 14 on display tray 10.

Each recess 14 has a first set of opposite sides 16*a* and 16*b*, and a second set of opposite sides 18*a* and 18*b* to define its area. Clips 20 (described with greater detail with reference to FIGS. 3 and 4, discussed herein) are resiliently and integrally molded from one of the first set of opposite sides 16*a*, and extend above upper face 34 of unitary surface 12, above recess 14, to define gaps 22 as shown in FIGS. 3, 4 and 8A–8F between a terminal end 21 of clip 20 and opposite end 16*b*. Recess 14 is preferably configured with its area being larger than the area of its respective clip 20 such that a ring 24 may be inserted within the clip 20 and be retained therein. Surface 12 and clips 20 are preferably molded from a lightweight plastic material, although other resilient or flexible materials may work equally well.

Figure 8A:
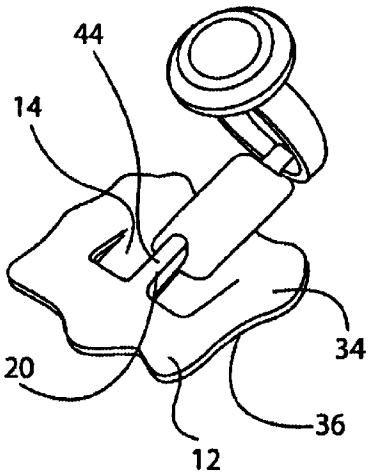
FIGS. 8A–8F illustrates a cut-away view of a series of clips from the unitarily molded display tray of FIG. 1, with a ring disposed therein, in accordance with one embodiment of the present invention.
Figure 8B:
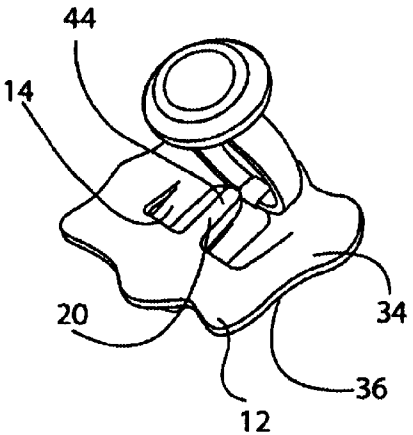
Figure 8C:
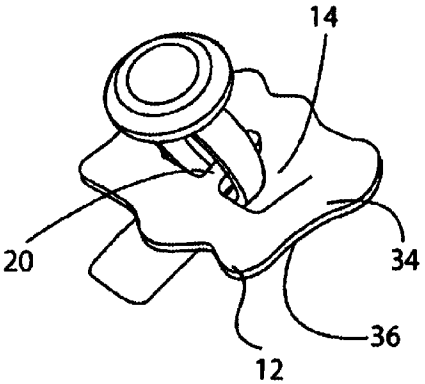
Figure 8D:
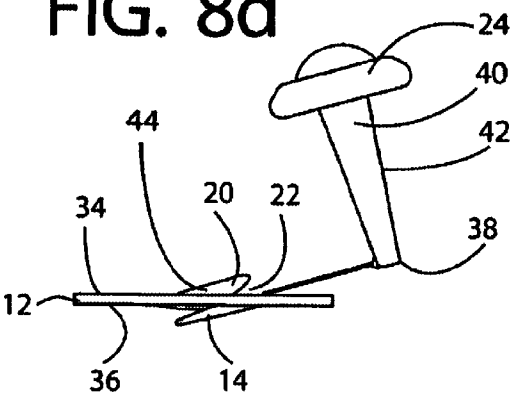
Figure 8E:
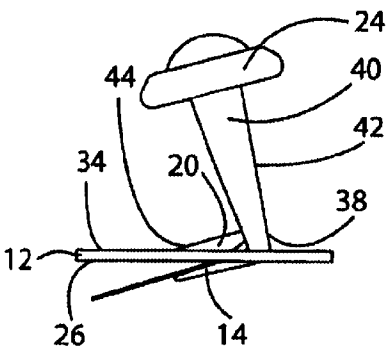
Figure 8F:
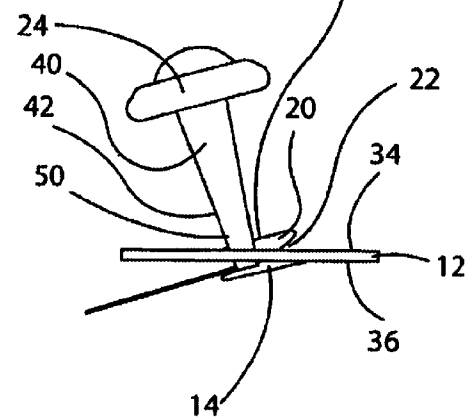

As illustrated in FIGS. 1–8(F), one or more rings 24 are displayed and retained on the clips 20 provided on display tray 10. As seen clearly in FIG. 1, ring 24 is generally comprised of a circular mass of precious metal such as gold, silver or platinum having a bore 42 through the mass of metal for the purpose of being worn on a person's finger. By placing ring 24 into one of the gaps 22 formed by the clips 20, an upper portion 38 of ring 24 is positioned to be displayed on tray 10 while a lower or shank portion 40 (FIGS. 2, 3 and 8A–8F) of ring 24 rests within the corresponding recess 14 of clip 20 such that ring 24 is securely retained on unitary surface 12 of display tray 10. As illustrated in FIGS. 8A and 8D, an indicia tag 26, attached to ring bore 42, is placed through gap 22. Next, ring shank 14 is slowly placed under clip 20 through gap 22 as seen in FIGS. 8B and 8E. Finally, as illustrated in FIGS. 8C and 8F, ring shank 40 of ring 24 is firmly secured for display, being pressed between clip 20 and the upper surface of recess 14, with indicia tag 26 displayed on lower face 36 of surface 12.

FIGS. 4–7 illustrates lower face 36 of unitary surface 12 which is provided with a plurality of rings 24 arranged thereon, the lower portion 40 of ring 24 extending within recesses 14. Furthermore, FIGS. 4–8 illustrate indicia tags 26 attached to the lower portions 40 of rings 24. The indicia tags 26 may be tied to ring 24 with string, adhesively attached with tape or looped around the lower portion 40 of the ring, although the invention is not limited in this respect. Indicia tags 26 generally contain information recorded thereon such as the composition of the ring 24 (e.g. gold, platinum, etc . . . ), the weight of the ring 24 (e.g. 14 kt, 18 kt, etc . . . ), the price, and an inventory number. Indicia tags 26 may also contain additional information as desired by the jewelry salesperson.

The upper portion of the ring 38 protrudes upward relative to the unitary surface 12, while the lower portion of the ring 40 protrudes below the unitary surface 12. However, clip 20, frictionally retains the ring to opposite side walls 18*a* and 18*b* at a location between the upper and lower ring portions 38, 40. The indicia tag 26, which is considered aesthetically displeasing to the arrangement of rings 24 on the unitary surface 12, is attached to the lower ring portion 40 and is strategically extended below unitary surface 12, through recess 14, and out of sight of consumers viewing from above the rings 24 arranged in display tray 10. Optionally, a felt pad (not shown) may be attached to unitary surface 12 so as to provide additional frictional engagement so as to secure ring 24 to the display tray 10.

Figure 3:
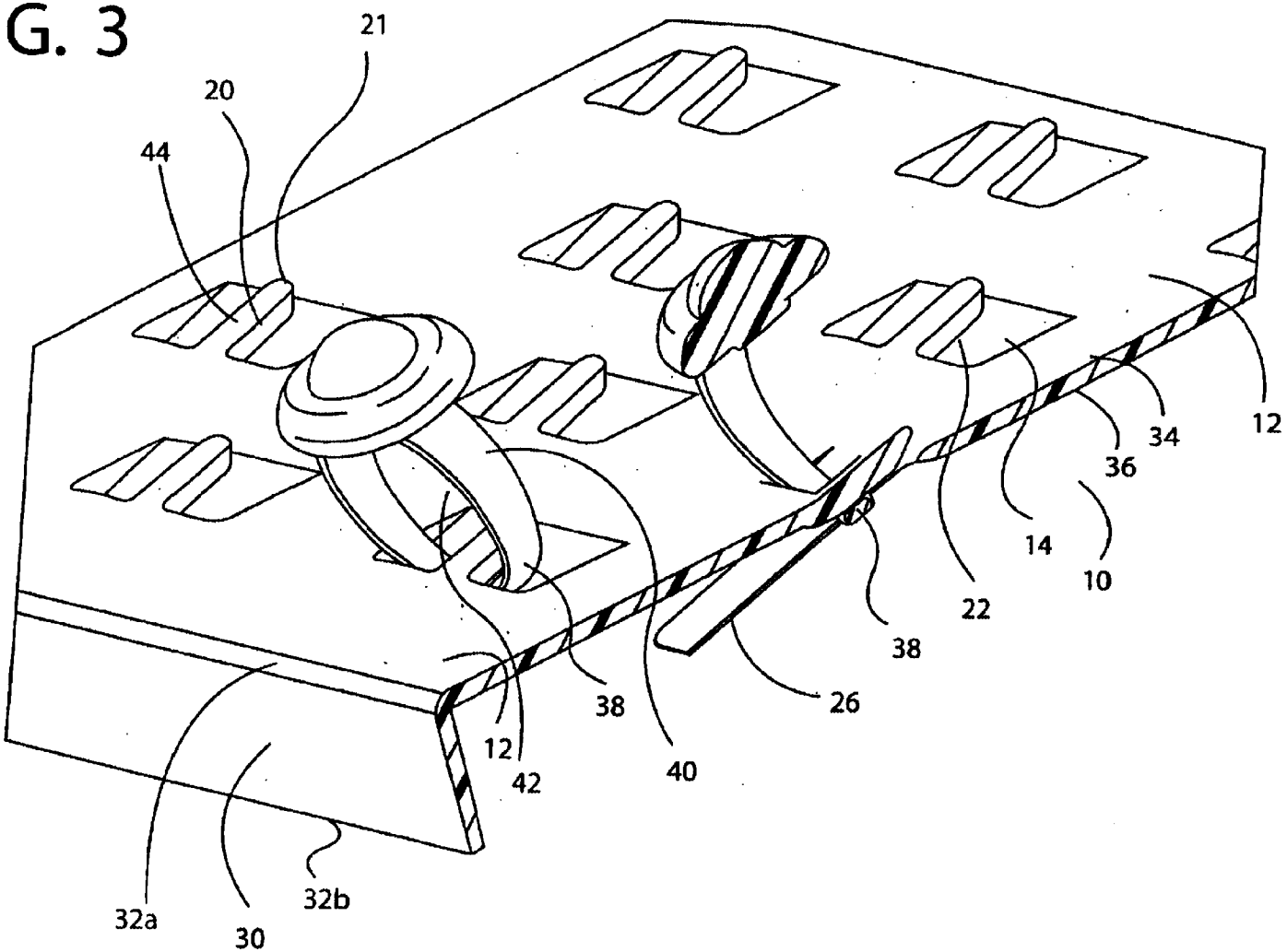
FIG. 3 illustrates a perspective cross-sectional view of the unitarily molded display tray of FIG. 1, in accordance with one embodiment of the present invention.
Figure 4:
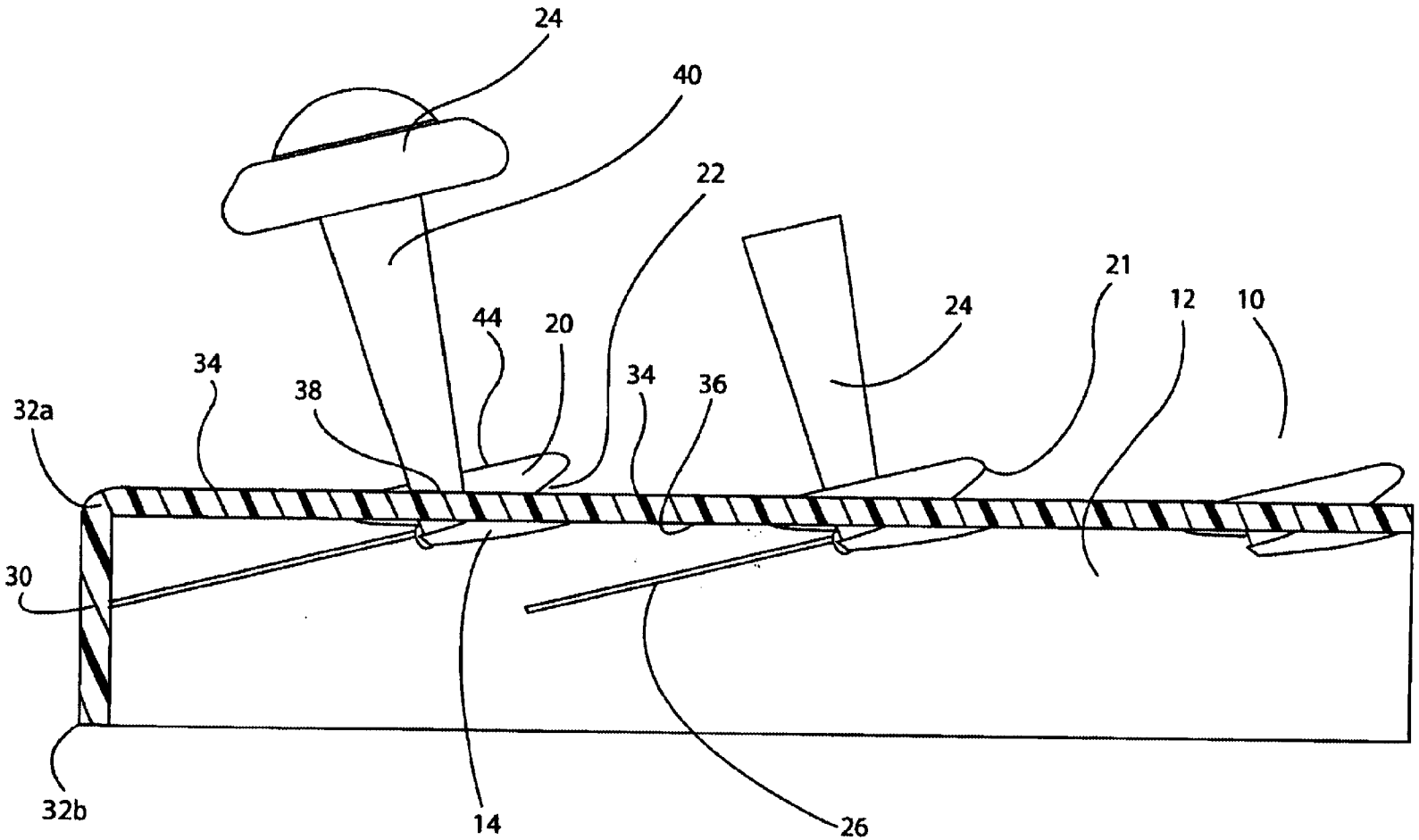
FIG. 4 illustrates a side cross-sectional view of the unitary molded display tray of FIG. 1, in accordance with one embodiment of the present invention.
Figure 5:
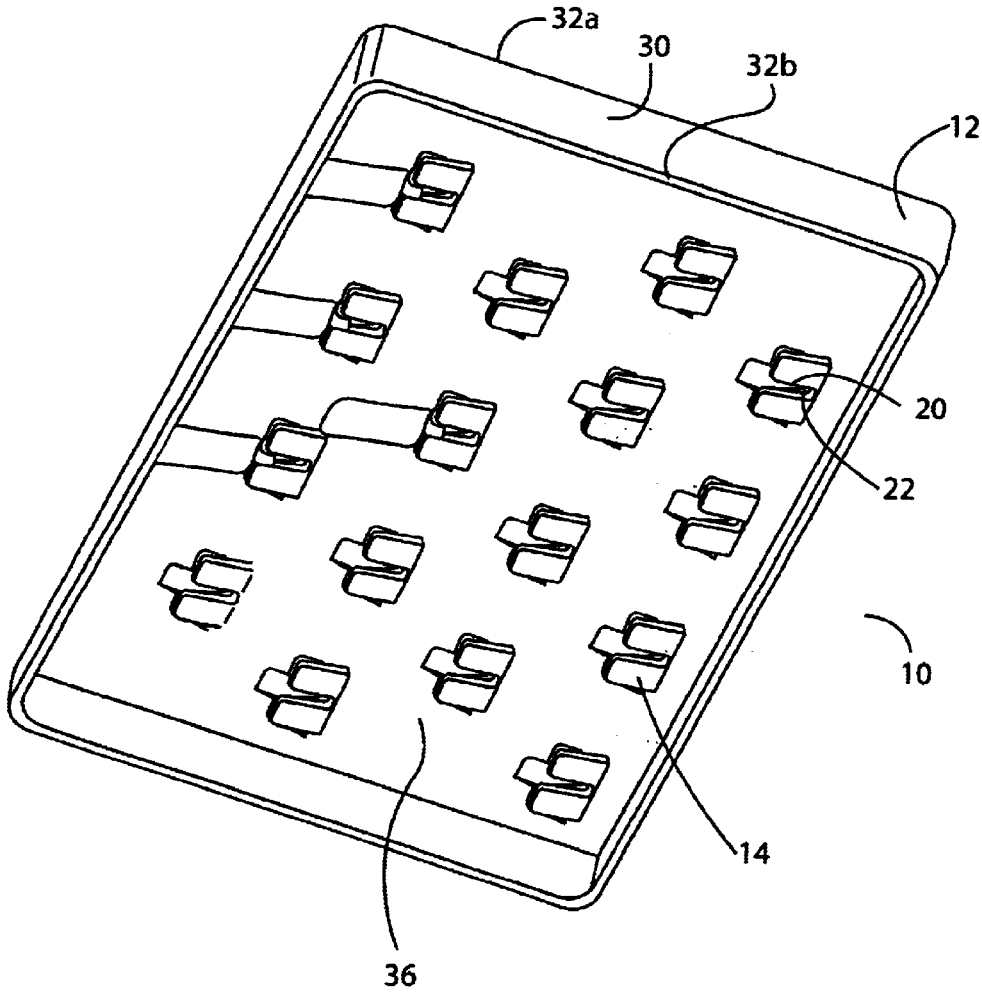
FIG. 5 illustrates a bottom side perspective view of the unitarily molded display tray of FIG. 1, in accordance with one embodiment of the present invention.
Figure 6:
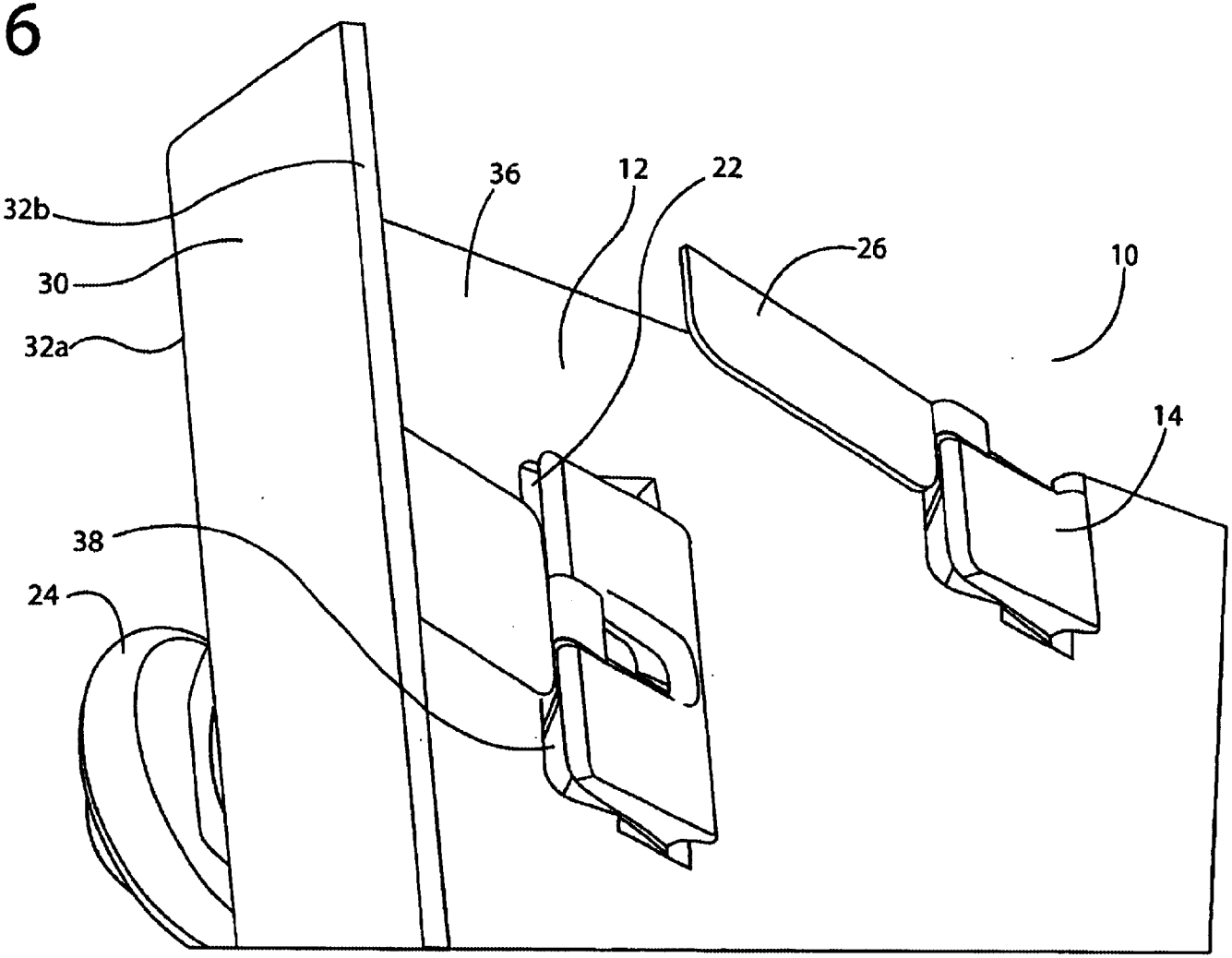
FIG. 6 illustrates a close up bottom side perspective view of the unitarily molded display tray of FIG. 1, in accordance with one embodiment of the present invention.
Figure 7:
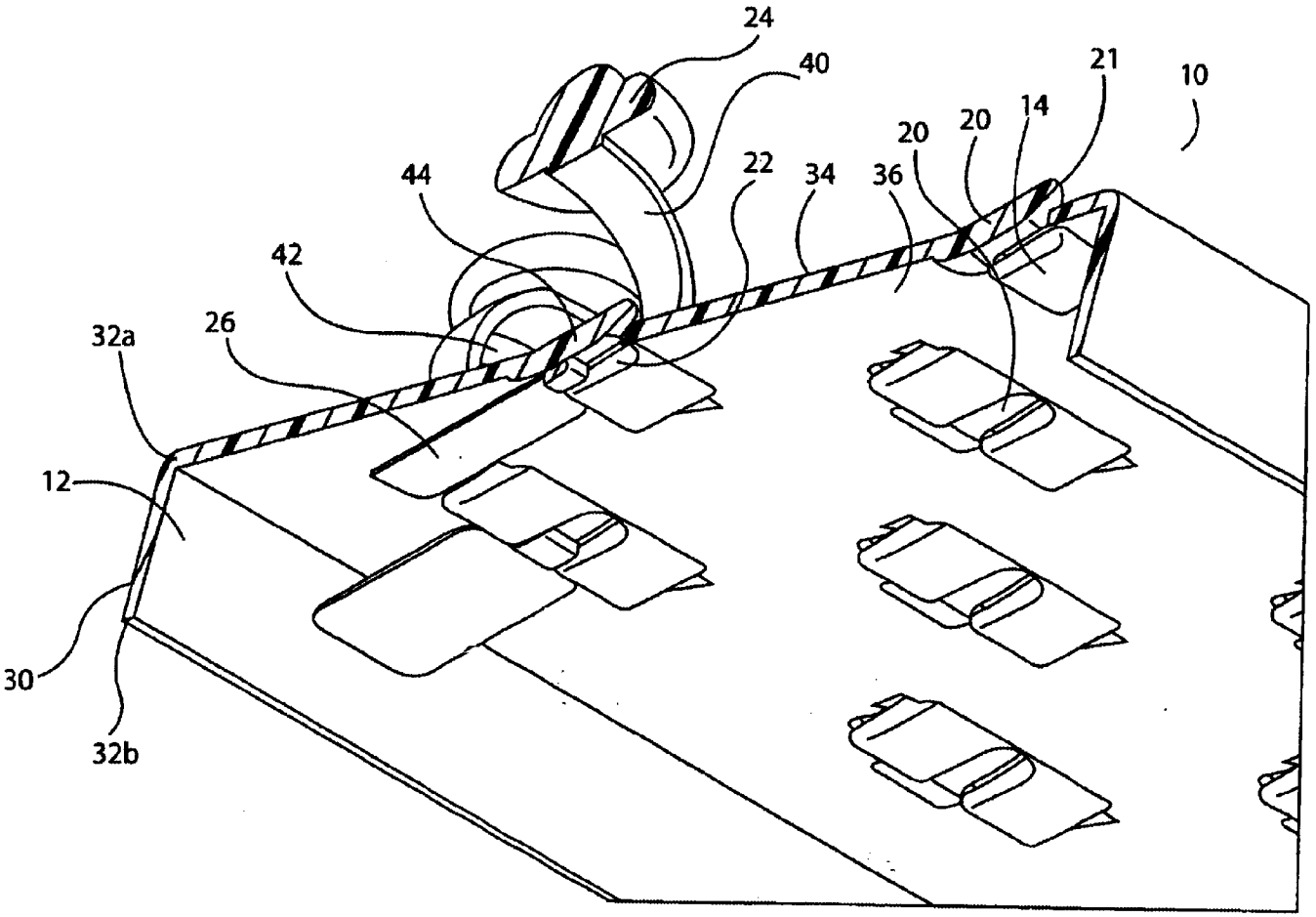
FIG. 7 illustrates a bottom side cross-sectional perspective view of the unitarily molded display tray of FIG. 1, in accordance with one embodiment of the present invention.

FIGS. 3 and 4 illustrate a cross-sectional view of unitary surface 12 and provides a more detailed view of clips 20. As shown in FIG. 4, clip 20 is unitarily molded from unitary surface 12 and extends from side 16 of recess 14 above upper face 34 of unitary surface 12. Clip 20 is preferably configured with a upwardly slanting top portion 44 that extends coaxially above upper surface 34 of unitary surface 12. The invention is not, however, limited in this respect and a curved top portion may work equally well.

The resilient nature of clip 20 facilitates removal of ring 24 from clip 20 by gently lifting clip 20 relative to surface 12 and sliding ring 24 out of recess 14. After ring 24 is removed, clip 20 reverts to its original position. It is to be understood that the discussion with reference to clip 20 is equally applicable to all clips 20 arranged on unitary surface 12.

FIGS. 1 and 3–7 illustrates unitary surface 12 provided with a continuous sidewall 30 extending substantially perpendicular to the unitary surface 12 and extending about the entire periphery of unitary surface 12, and having upper portion 32*a* and lower portion 32*b*. Sidewall 30 may be configured to facilitate placement of display tray 10 on a surface and/or for making display tray 10 more aesthetically pleasing as a stand-alone display.

Sidewall 30 may be further configured to permit stacking of numerous display trays 10 upon each other. For instance, upper portion 32*a* of sidewall 30 may be slanted inward to receive a display tray 10 stacked above it. Additionally, lower portion 32*b* of sidewall 30 may be flared so as to be placed upon the inwardly slanted upper portion 32*a* of another display tray. It is to be understood, that other configurations may also be utilized to permit numerous display trays 10 to be stacked upon each other. Moreover, a felt or velvet pad (not shown) may be provided on upper face 34 of unitary surface 12. The pad provide additional retention along with clips 20 and additionally prevent the scratching or tarnishing of rings 24 which rest in the recesses 14 and interact with sides 18*a* and 18*b*.

It is to be appreciated that although the apparatus of the present invention has, been described with reference to retaining, displaying and storing rings, the apparatus may be configured to work equally well with other articles of jewelry such as bracelets, anklets, and watches.

Thus, while there have been shown and described and pointed out fundamental novel features of the invention as applied to preferred embodiments thereof, it will be understood that various omissions and substitutions and changes in the form and details of the disclosed invention may be made by those skilled in the art without departing from the spirit of the invention. It is the intention, therefore, to be limited only as indicated by the scope of the claims appended hereto.

It is to be understood that the drawings are not necessarily drawn to scale, but that they are merely conceptual in nature.

It is to be understood that the drawings are not necessarily drawn to scale, but that they are merely conceptual in nature.

What is claimed is:

1. A unitarily molded display tray for displaying articles of jewelry having indicia tags, said tray comprising:

a unitary surface having an upper face and a lower face, said surface having a plurality of recesses dispersed about said upper face of said unitary surface, each of said recesses having two sets of first and second opposite sides; and a plurality of clips, each clip corresponding with one of said recesses, said clips molded from said unitary flat surface for retaining articles of jewelry thereon, said clips resiliently attached to one of said first set of opposite sides wherein said recesses are defined by said side opposite said clip and said second set of opposite sides, said clips extending above said unitary surface to define a gap between said clip and said unitary surface wherein an article of jewelry is retained in said clip, wherein a portion of said article of jewelry extends within said recess wherein indicia tags attached to said articles of jewelry are disposed within said recess and below said single plane unitary surface such that said indicia tags are placed out of sight when said display tray is viewed from above.

2. The display tray of claim 1, wherein said clip further comprises an upwardly slanting top portion so as to prevent said article of jewelry from slipping off of said clip.

3. The display tray of claim 1 wherein said plurality of clips are arranged about said upper face of said unitary surface in columns.

4. The display tray of claim 1, wherein said plurality of clips are arranged about said upper face of said unitary surface in rows.

5. The display tray of claim 1, wherein said plurality of clips are randomly dispersed about said upper face of said unitary surface.

6. The display tray of claim 1, further comprising a continuous sidewall substantially perpendicular to said unitary surface and extending about the entire periphery of said unitary surface for facilitating placement on a display surface.

7. The display tray of claim 1, further comprising a felt pad disposed on said upper face of said unitary surface, wherein said felt pad is disposed on one or both sides of said recesses on said upper face of said unitary surface for engaging said articles of jewelry on said clips, and wherein said articles of jewelry rest upon said felt pad when said article of jewelry is disposed on said clip.

8. The display tray of claim 1, wherein said unitarily molded clip is molded from a lightweight plastic material.

9. The display tray of claim 1, wherein said recess is provided with an area larger that the area of said clips.

* * * * *